US005446251A

United States Patent [19]

Lin

[11] Patent Number: 5,446,251

[45] Date of Patent: Aug. 29, 1995

[54] CONDUCTING ASSEMBLY FOR A MICRO SWITCH

[75] Inventor: Ching-Chuan Lin, Hsin Tien, Taiwan

[73] Assignee: Shin Jiuh Corp., Hsin Tien, Taiwan

[21] Appl. No.: 161,527

[22] Filed: Dec. 6, 1993

[51] Int. Cl.[6] ..... H01H 1/00

[52] U.S. Cl. ..... 200/284; 200/303

[58] Field of Search ..... 200/284, 303

[56] References Cited

U.S. PATENT DOCUMENTS 3,878,344 4/1975 Lockard ..... 200/303 X 3,883,705 5/1975 Sebastian et al. ..... 200/303 X 4,673,778 6/1987 Lewandowski et al. .

*Primary Examiner*—Renee S. Luebke

*Attorney, Agent, or Firm*—Sandler, Greenblum & Bernstein

[57] ABSTRACT

A conducting assembly of a micro switch includes an insulating member which is made up of two molded pieces and a conducting unit which is enclosed partially by the molded pieces. The conducting unit includes a leg portion which is provided with a longitudinal reinforcing member that is formed along its length. The reinforcing member is partially enclosed by the insulating member.

6 Claims, 3 Drawing Sheets

CONDUCTING ASSEMBLY FOR A MICRO SWITCH

BACKGROUND OF THE INVENTION

1. Field of the Invention

The invention relates a conducting assembly, more particularly to a conducting assembly for a micro switch.

2. Description of the Related Art

FIG. 1 shows a conventional micro switch 10 which is installed in a telephone base (not shown) so as to serve as a plunger of the telephone base and which is depressed by a telephone hand set (not shown) when the telephone set (not shown) is not in use. As best illustrated, the conventional micro switch includes a seat member 1, a pair of conducting assemblies 2, a pivot frame 3, a cover member 4 and a compression spring 5.

The seat member 1 is a rectangular casing with an open top and includes a front wall 111, a rear wall 112 and two opposed side walls 113 which interconnect the front and rear walls 111, 112 to define the casing. A pair of opposed curved notches 11 are formed respectively at the top portion of the opposed side walls 113 adjacent to the front wall 111. A partition 114 divides the casing into a front compartment and a rear compartment in cooperation with the front wall 111 and the rear wall 112. The partition 114 has two engaging grooves 12 in communication with the front compartment. The bottom of the front compartment has four engaging recesses 13 formed therein and aligned with the engaging grooves 12. A pair of conducting plates 14 extend upwardly from the bottom of the rear compartment adjacent to the rear wall 112. Each of the conducting plates 14 has a first end which passes through the bottom of the casing so as to contact respective ones of the electrical circuits of the telephone set. The second end of each of the conducting plates 14 has an upper contact 14' and a lower contact 14'' that are located above the bottom so as to be disposed in the rear compartment of the casing. The conducting plates 14 are aligned respectively with the engaging grooves 12 of the partition 114. The rear wall 112 has an engaging projection 15 formed on an inner face thereof.

Each of the conducting assemblies 2 includes an insulating member 23 which encloses partially two conducting units 21. Each of the conducting units 21 includes two leg portions 201*a*, 202*a* which are engaged within the engaging recesses 13 of the casing when the insulating member 23 is inserted so as to engage the engaging grooves 12 of the partition 114. The head portions 201', 202' of the conducting units 21 extend out of the insulating member 23 and are substantially perpendicular to the leg portions 201*a*, 202*a*. Under this condition, the head portions 201', 202' respectively contact the upper and lower contacts 14', 14'' of the respective conducting plate 14.

The pivot frame 3 is made of an insulating material and is provided on the seat member 1. The pivot frame 3 includes a pivot rod 32 which is received by the curved notches 11 of the opposed walls 113, an engaging groove 342 which is formed on an external face of a rear end 34 of the frame 3 and which engages the projection 15 slidingly, and two insulating tabs 341 that are formed on an internal face of the rear end of the frame 3. The insulating tabs 341 are respectively aligned with two contact points respectively constituted by the two head portions 201', 202' and the contacts 14', 14'' of the conducting plates 14. A spring retaining unit 33 is formed at an intermediate portion of the pivot frame 3.

The cover member 4 includes a spring retaining unit 41 which projects downwardly therefrom. The cover member 4 is provided on the seat member 1 so as to enclose the pivot frame 3 between the cover member 4 and the seat member 1 with the compression spring 5 being retained by the retaining units 33, 41. When the telephone hand set is on the telephone base, the plunger 31 is depressed downward so as to compress the compression spring 5, wherein the pivot frame 3 pivots counterclockwise about the pivot rod 32 so as to raise the rear end 34 of the pivot frame 3 to dispose the insulating tabs 341 between the head portions 201' of the conducting units 21 and the upper contact 14' of the conducting plates 14, thereby permitting electrical connection between the lower contact 14'' and the remaining one of the head portion 202'.

When the telephone hand set is lifted from the base, the plunger 31 of the pivot frame 3 pops up from the telephone base due to the expanding force of the compression spring 5, thereby switching the electrical connection to the position between the upper contact 14' and the head portion 201'.

Referring to FIG. 2, each of the leg portions 201*a*, 202*a* of the conducting unit 21 has two opposed faces and a longitudinal rib 22 formed as a reinforcing member along a length thereof with a convex face which is integral with one of the opposed faces and a concave face which corresponds to the convex face and which is integral with the other one of the opposed faces. The insulating member 23 is formed by means of injection molding so as to enclose the intermediate portion of the conducting unit 21. During the formation of the insulating member 23, the mold for receiving the molding substance therein so as to form the insulating member 23 does not enclose any portion of the longitudinal rib 22. If the mold encloses a portion of the longitudinal rib 22, the molding substance will leak via the concave face and the gap between the convex face and the face of the mold. Under such a condition, a part of the leg portions 201*a*, 202*b* will have some barrier formed by the molding substance which makes it difficult to insert of the leg portions 201*a*, 202*b* through the engaging recesses 13 and to perform the succeeding operations. Thus, the leg portions 201*a*, 202*a* of the conducting units 21 are susceptible to break adjacent to the insulating members 23.

SUMMARY OF THE INVENTION

Therefore, a main objective of the present invention is to provide a conducting assembly for a micro switch which includes at least one conducting unit with a leg portion that has a reinforcing member integrally formed therewith and extending partially into an insulating member, thereby strengthening the rigidity of the leg portion of the conducting assembly.

Another objective of the present invention is to provide such a conducting assembly without any barrier formed by molding substance on the leg portion during the molding process.

Accordingly, the micro switch using the conducting assemblies of the present invention is similar to that of the conventional micro switch except that each of the conducting assemblies includes two corresponding molded insulating pieces which are connected to one another so as to partially enclose two conducting units. Each of the conducting units includes two leg portions which respectively has a longitudinal reinforcing member formed integrally therewith along its length. A portion of the longitudinal reinforcing member extends into and is enclosed by the insulating pieces.

In one preferred embodiment, each of the leg portions has two opposed faces. The longitudinal reinforcing member is constituted by a longitudinal rib that has a convex face which is integrally formed with one of the opposed faces and a concave face which corresponds to the convex face and which is integral with the other one of the opposed faces. Each of the insulating pieces of this preferred embodiment has an axis parallel to the leg portions and a holding arm that extends from the insulating piece and that is substantially perpendicular to the axis and that cooperates with the holding arm of the other one of the insulating pieces to define a through-hole which extends parallel to the axis of the insulating piece.

In another preferred embodiment, each of the elongated leg portions has two opposed faces that constitute the reinforcing member, one of which is wholly convex-shaped and the other one of which is wholly concave-shaped.

The leg portions of the conducting assemblies of the present invention have a rigidity which is far stronger than that of the leg portions of the conducting assemblies of the conventional micro switch.

BRIEF DESCRIPTION OF THE DRAWINGS

Other features and advantages of the present invention will become more apparent in the following detailed description of the preferred embodiment of the present invention with reference to the accompanying drawings, in which.

DETAILED DESCRIPTION OF THE PREFERRED EMBODIMENT

Figure 1:
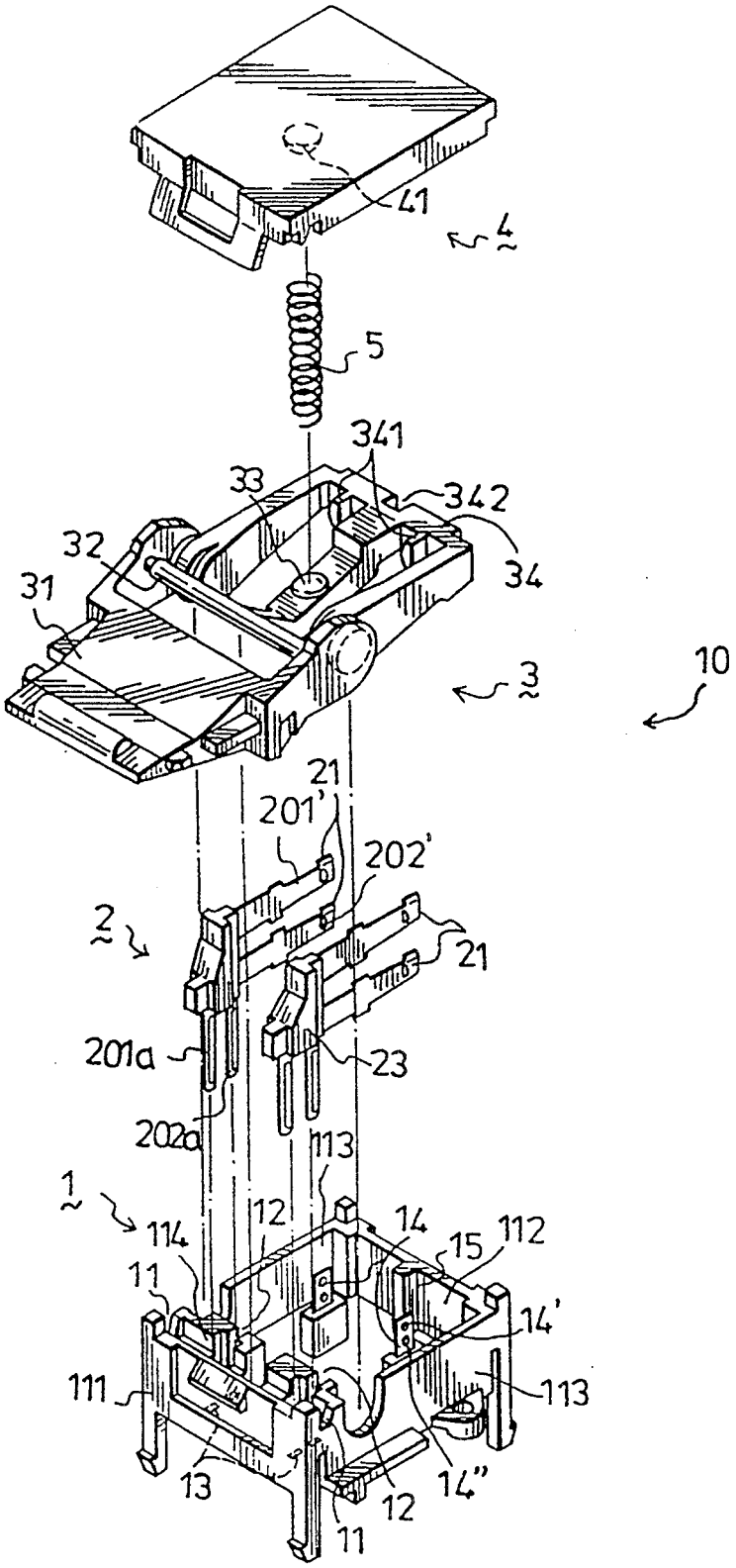
FIG. 1(PRIOR ART)
FIG. 1 shows an exploded view of a conventional micro switch which is used in a telephone base.

Before the present invention is described in greater detail, it should be noted that except for the characterizing parts, the like elements are indicated by the same reference numerals throughout the disclosure.

Figure 2:
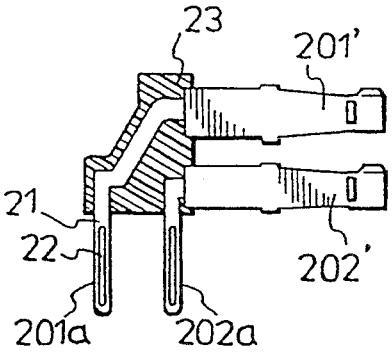
FIG. 2 (PRIOR ART)
FIG. 2 shows an enlarged view of a conducting assembly employed in the conventional micro switch.

Since the present invention is generally similar to the conventional micro switch shown in FIGS. 1 and 2, only the characterizing parts of the present invention will be described herein.

Figure 3:
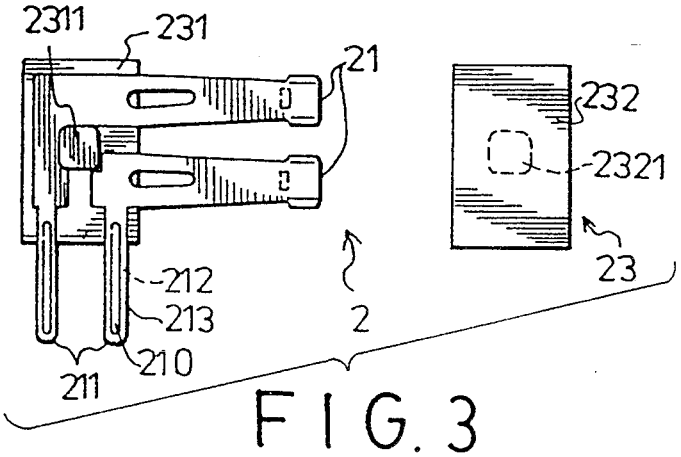
FIG. 3 illustrates an enlarged and partially exploded view of a conducting assembly of the present invention which is used in a micro switch.

Referring to FIG. 3, a conducting assembly 2 according to the present invention which is to be employed in a micro switch that, in turn, is to be employed in a telephone base includes an insulating member 23 which is constituted by first and second molded insulating pieces 231, 232 which are connected to one another by means of male-and-female connection, such as a projection 2311 and a recess 2321. The conducting assembly 2 further includes two conducting units 21, each of which having two leg portions 211 that extend out of the insulating member 23 in a parallel relationship and that are provided with a respective longitudinal reinforcing member 210 formed integrally along the lengths thereof. The insulating member 23 encloses a portion of the reinforcing member 210 so that a remaining portion of the reinforcing member 210 is exposed to an exterior of the insulating member 23. Thus, the exposed leg portion 211 is not susceptible to breakage.

Figure 4:
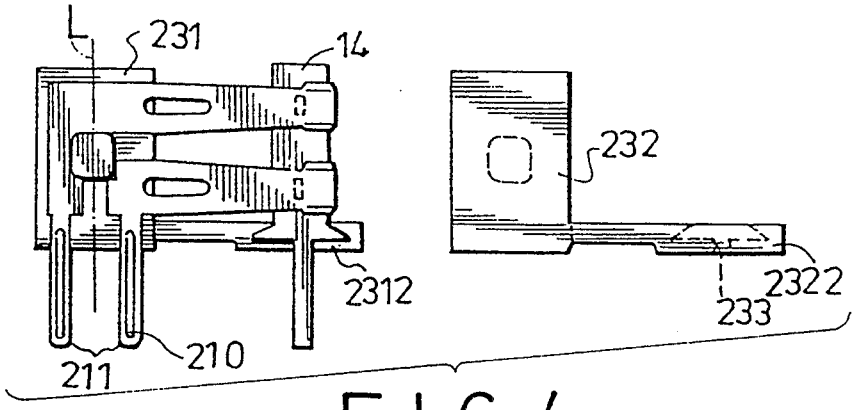
FIG. 4 illustrates another preferred embodiment of the conducting assembly of the present invention.

In one preferred embodiment, the leg portion 211 has two opposed faces and the longitudinal reinforcing member 210 is constituted by a longitudinal rib 212 which is formed on the leg portion 211. The longitudinal rib 212 has a concave face 213 which is integral with one of the opposed faces and a convex face 212 which corresponds to the concave face 213 and which is integral with the other one of the opposed faces. In another embodiment, each of the insulating pieces 231, 232 has an axis "L"" which is parallel to the leg portion 211 and a holding arm 2312, 2322 which extends therefrom and which is substantially perpendicular with the axis "L." The two holding arms 2312, 2322 cooperatively define a through-hole 233 which extends parallel to the leg portions 211 so as to receive engageably the first ends of the conducting plates 14, as shown in FIG. 4.

Figure 5:
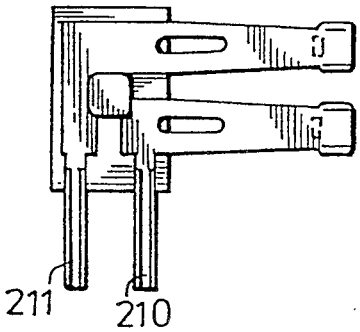
FIG. 5 shows still another preferred embodiment of the conducting assembly of the present invention.

Referring to FIG. 5, in still another embodiment, each of the elongated leg portion 211 has two opposed faces that constitute the reinforcing member 210, one of which is wholly convex-shaped and the other one of which is wholly concave-shaped.

Since the leg portions 211 of the conducting unit 21 of the conducting assembly 2 according to the present invention have reinforcing members 210 that extend into the insulating member 23, the leg portions 211, therefore, have a rigidity which is far stronger than that of the leg portions described in the prior art. The feature and object of the present invention is thus achieved.

While preferred embodiments have been explained and described, it will be apparent that many changes and modifications can be made in the general construction and arrangement of the present invention without departing from the scope and spirit thereof. Therefore, it is desired that the present invention not be limited to the exact disclosure but only to the extent of the appended claims.

I claim:

1. A conducting assembly for a micro switch including at least one conducting unit and an insulating member partially enclosing said conducting unit, said conducting unit having two elongated leg portions extending out from said insulating member in a parallel relationship;

said insulating member including two molded insulating pieces which are connected together at opposed surfaces, each of said elongated leg portions having a longitudinal reinforcing member formed integrally with said elongated leg portion along a length thereof, each elongated leg portion being held between said opposed surfaces of said two molded insulating pieces, wherein said reinforcing member is partially enclosed by said insulating member.

2. The conducing assembly as defined in claim 1, wherein said insulating pieces are connected by a male-and-female connection.

3. The conducting assembly as claimed in claim 1, wherein each of said elongated leg portions has two opposed faces, said longitudinal reinforcing member being constituted by a longitudinal rib having a convex face which is integral with one of said opposed faces and a concave face which corresponds to said convex face and which is integral with the other one of said opposed faces.

4. The conducting assembly as claimed in claim 1, wherein each of said insulating pieces has an axis parallel to said elongated leg portions and a holding arm extending from each said insulating piece, said holding arm of one of said insulating pieces being substantially perpendicular to said axis and cooperating with said holding arm of the other of said insulating pieces to define a through-hole which extends parallel to said axis of said insulting piece.

5. The conducting assembly as defined in claim 1, wherein each of said elongated leg portions has two opposed faces that constitute said reinforcing member, one of which is wholly convex-shaped and the other one of which is wholly concave-shaped.

6. A conducting assembly for a micro switch including at least one conducting unit and an insulating member partially enclosing said conducting unit, said conducting unit having two elongated leg portions extending out from said insulating member in a parallel relationship;

said insulating member including two molded insulating pieces which are connected together, each of said elongated leg portions having a longitudinal reinforcing member formed integrally with said elongated leg portion along a length thereof, said reinforcing member being partially enclosed by said insulating member; and wherein each of said insulating pieces has an axis parallel to said elongated leg portions and a holding arm extending from each said insulating pieces, said holding arm of one of said insulating pieces being substantially perpendicular to said axis and cooperating with said holding arm of the other of said insulating pieces to define a through-hole which extends parallel to said axis of said insulting piece.

* * * * *

UNITED STATES PATENT AND TRADEMARK OFFICE

CERTIFICATE OF CORRECTION

PATENT NO. : 5,446,251
DATED : August 29, 1995
INVENTOR(S) : Ching-Chuan LIN

It is certified that error appears in the above-indentified patent and that said Letters Patent is hereby corrected as shown below:

At column 4, line 16, change " "L"" " to ---"L"---.
At column 2, line 44, delete "of".
At column 3, line 66, change "having" to ---has---.
At column 6, line 18 (claim 6, line 21), change "insulting" to --- insulating---.

Signed and Sealed this

Nineteenth Day of March, 1996

Bruce Lehman

*Attest:*

BRUCE LEHMAN

*Attesting Officer*

*Commissioner of Patents and Trademarks*